US011815828B2

(12) United States Patent
Sobue et al.

(10) Patent No.: US 11,815,828 B2
(45) Date of Patent: Nov. 14, 2023

(54) DEVELOPING DEVICE

(71) Applicant: CANON KABUSHIKI KAISHA, Tokyo (JP)

(72) Inventors: Fumitaka Sobue, Chiba (JP); Koichiro Ino, Tokyo (JP); Yosuke Hata, Chiba (JP); Masaaki Moriya, Ibaraki (JP); Norio Negishi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/551,403

(22) Filed: Dec. 15, 2021

(65) Prior Publication Data

US 2022/0236664 A1 Jul. 28, 2022

(30) Foreign Application Priority Data

Jan. 25, 2021 (JP) ..... 2021-009427

(51) Int. Cl.
*G03G 15/08* (2006.01)

(52) U.S. Cl.
CPC ..... *G03G 15/0853* (2013.01); *G03G 15/0889* (2013.01); *G03G 15/086* (2013.01)

(58) Field of Classification Search
CPC ..... G03G 15/0853; G03G 15/086; G03G 15/0889
See application file for complete search history.

(56) References Cited

U.S. PATENT DOCUMENTS

| | | | | |
|---|---|---|---|---|
| 9,915,893 | B2 | 3/2018 | Kotani | |
| 2016/0084924 | A1* | 3/2016 | Osumi | G01R 33/1223 324/236 |
| 2017/0115598 | A1 | 4/2017 | Kotani | |

FOREIGN PATENT DOCUMENTS

| | | | | |
|---|---|---|---|---|
| JP | H06-76961 | B2 | 9/1994 | |
| JP | H11-143209 | B2 | 5/1999 | |
| JP | 11-249407 | * | 9/1999 | G03G 15/08 |
| JP | 2017-083620 | A | 5/2017 | |
| JP | 2019-117251 | A | 7/2019 | |

* cited by examiner

*Primary Examiner* — Hoang X Ngo
(74) *Attorney, Agent, or Firm* — VENABLE LLP

(57) ABSTRACT

A developing device includes a developer carrying member configured to carry a developer, containing toner and a carrier, for developing an electrostatic latent image formed on an image bearing member, a developer container configured to accommodate the developer, and an oscillation circuit including a resonance circuit including a coil and a circuit portion containing a capacitor and configured to oscillate a signal for detecting a toner concentration of the developer accommodated in the developer container. The coil is formed integrally with the developer container by a metal film, and the coil is disposed on an inner wall surface of the developer container.

13 Claims, 11 Drawing Sheets

(a)

(b)

DEVELOPING DEVICE

FIELD OF THE INVENTION AND RELATED ART

The present invention relates to a developing device for developing an electrostatic latent image, with toner, on an image bearing member such as a photosensitive drum.

In the image forming apparatus, the electrostatic latent image on the image bearing member such as the photosensitive drum is developed by the developing device. As a constitution of the developing device, a constitution in which development is carried out by using a developer containing the toner and a carrier has been conventionally used. In such a developing device, it is required that a toner concentration in the developing device is appropriately detected.

As a sensor for detecting the toner concentration, a constitution in which the toner concentration is detected from a change in inductance of a coil of an oscillation circuit has been conventionally known. For example, Japanese Laid-Open Utility Model Application (JP-U) Hei 6-76961 discloses a toner concentration detecting sensor in which a helical pattern formed on a printed board is used as a coil of an LC oscillation circuit. In the case of the constitution disclosed in JP-U Hei 6-76961, the printed board on which the coil pattern is formed is mounted on an inner wall surface of a developer container.

In order to detect the toner concentration with accuracy, it is required that a distance between the coil and the developer is made small. In the constitution disclosed in JP-U Hei 6-76961, the printed board formed separately from the developer container is mounted on the inner wall surface of the developer container, and therefore, there is a liability that a position of the coil pattern is deviated from a desired position due to a mounting tolerance or the like. In this case, there is a possibility that this deviation has the influence on detection accuracy of the sensor.

SUMMARY OF THE INVENTION

A principal object of the present invention is to provide a developing device capable of improving detection accuracy of a toner concentration of a developer accommodated in a developer container.

According to an aspect of the present invention, there is provided a developing device comprising: a developer carrying member configured to carry a developer, containing toner and a carrier, for developing an electrostatic latent image formed on an image bearing member; a developer container configured to accommodate the developer; and an oscillation circuit including a resonance circuit constituted by a coil and a circuit portion containing a capacitor and configured to oscillate a signal for detecting a toner concentration of the developer accommodated in the developer container, wherein the coil is formed on an inner wall surface of the developer container.

Further features of the present invention will become apparent from the following description of exemplary embodiments with reference to the attached drawings.

Figure 4:
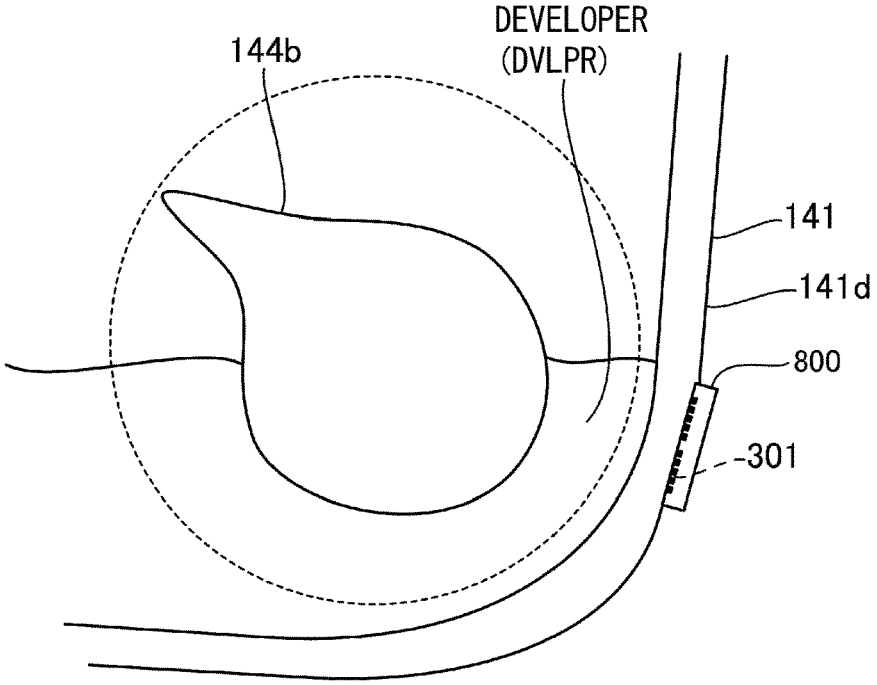
Figure 4:
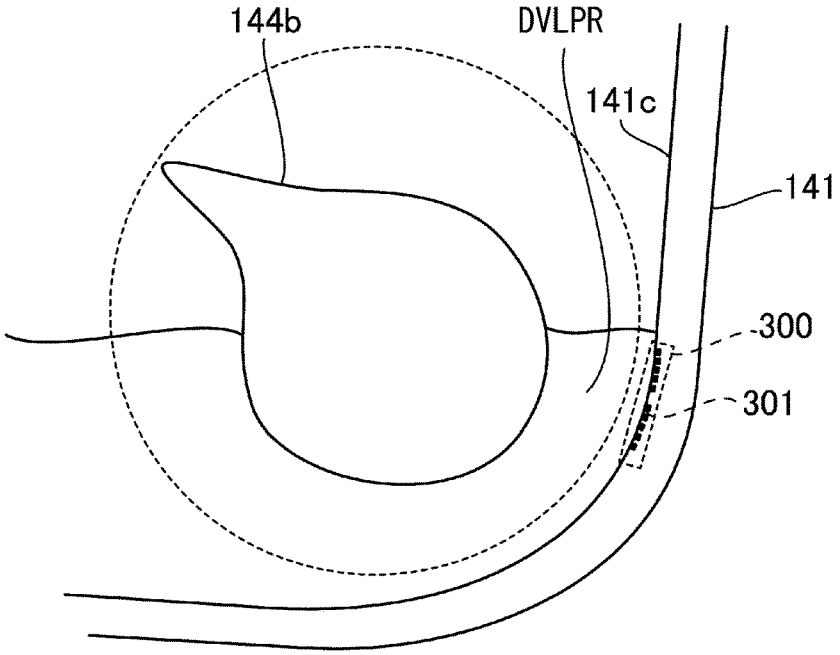

Parts (a) and (b) of FIG. 4 are schematic structural sectional views of developing devices, according to a comparison example and the first embodiment, respectively, each in the neighborhood a toner concentration detecting sensor.

Figure 5:
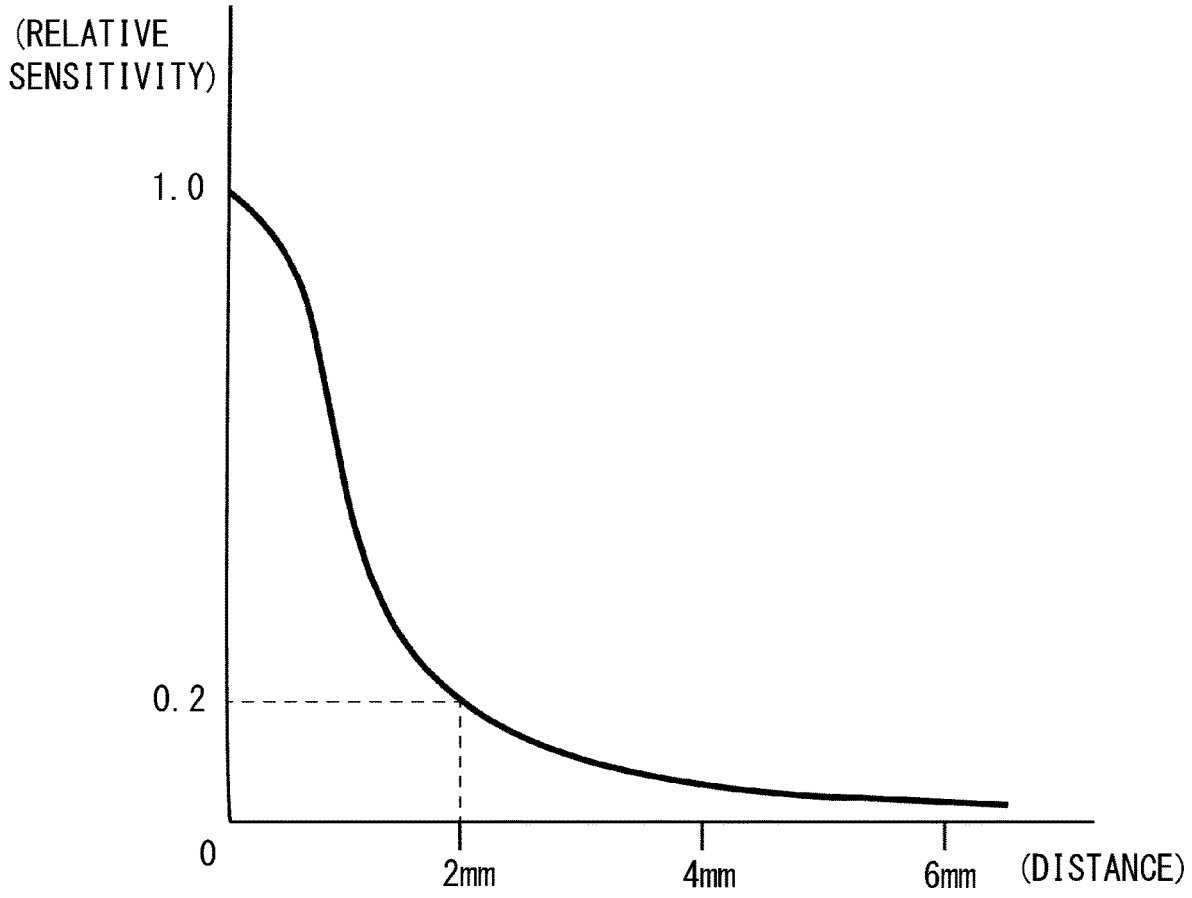

FIG. 5 is a graph showing a relationship between sensitivity and a distance of the toner concentration detecting sensor from an inner wall surface of the developer container.

Figure 6:
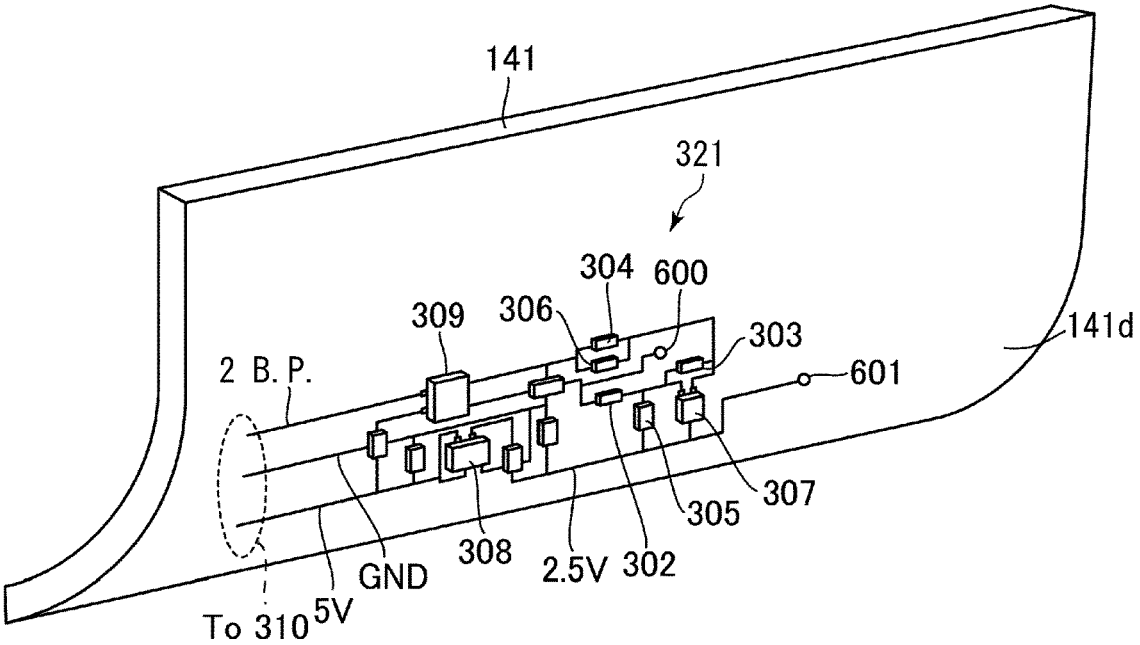

FIG. 6 is a perspective view showing only a portion of the developer container according to the first embodiment, where a circuit portion is formed.

Figure 7:
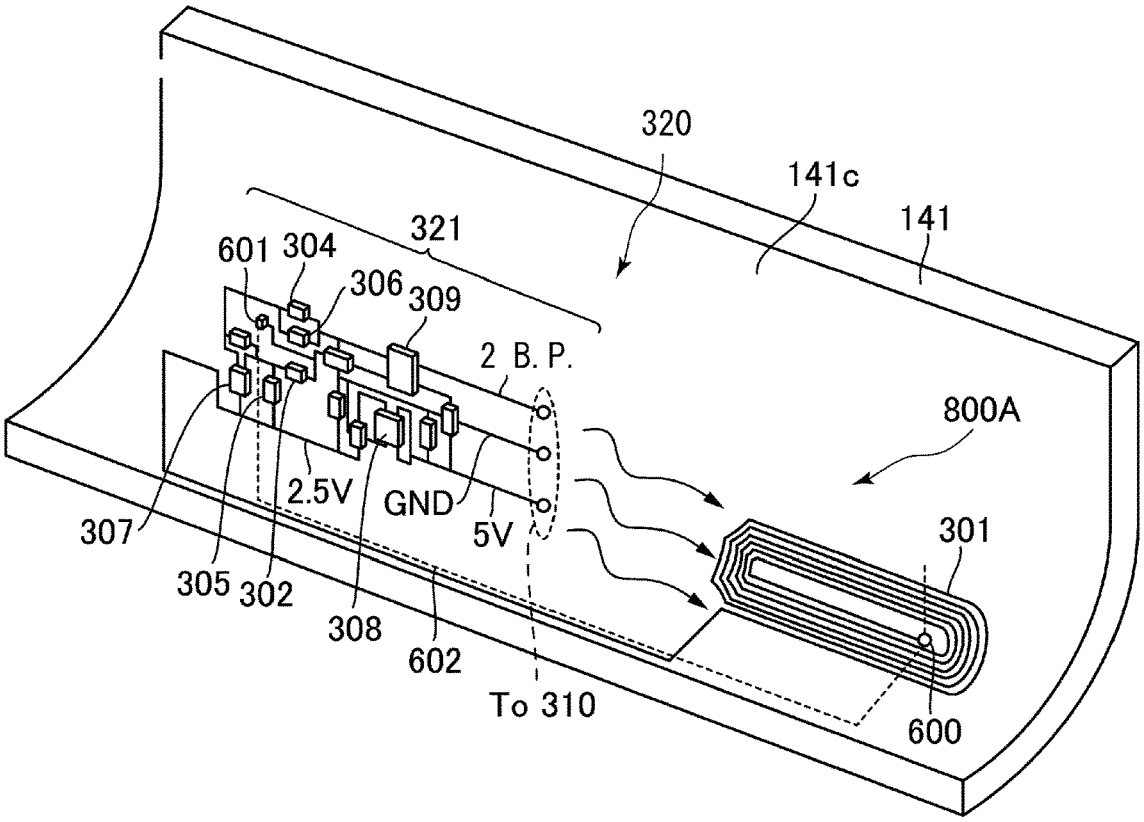

FIG. 7 is a perspective view showing only a portion of a developer container according to a reference example of a second embodiment, where a coil pattern and a circuit portion are formed.

Figure 8:
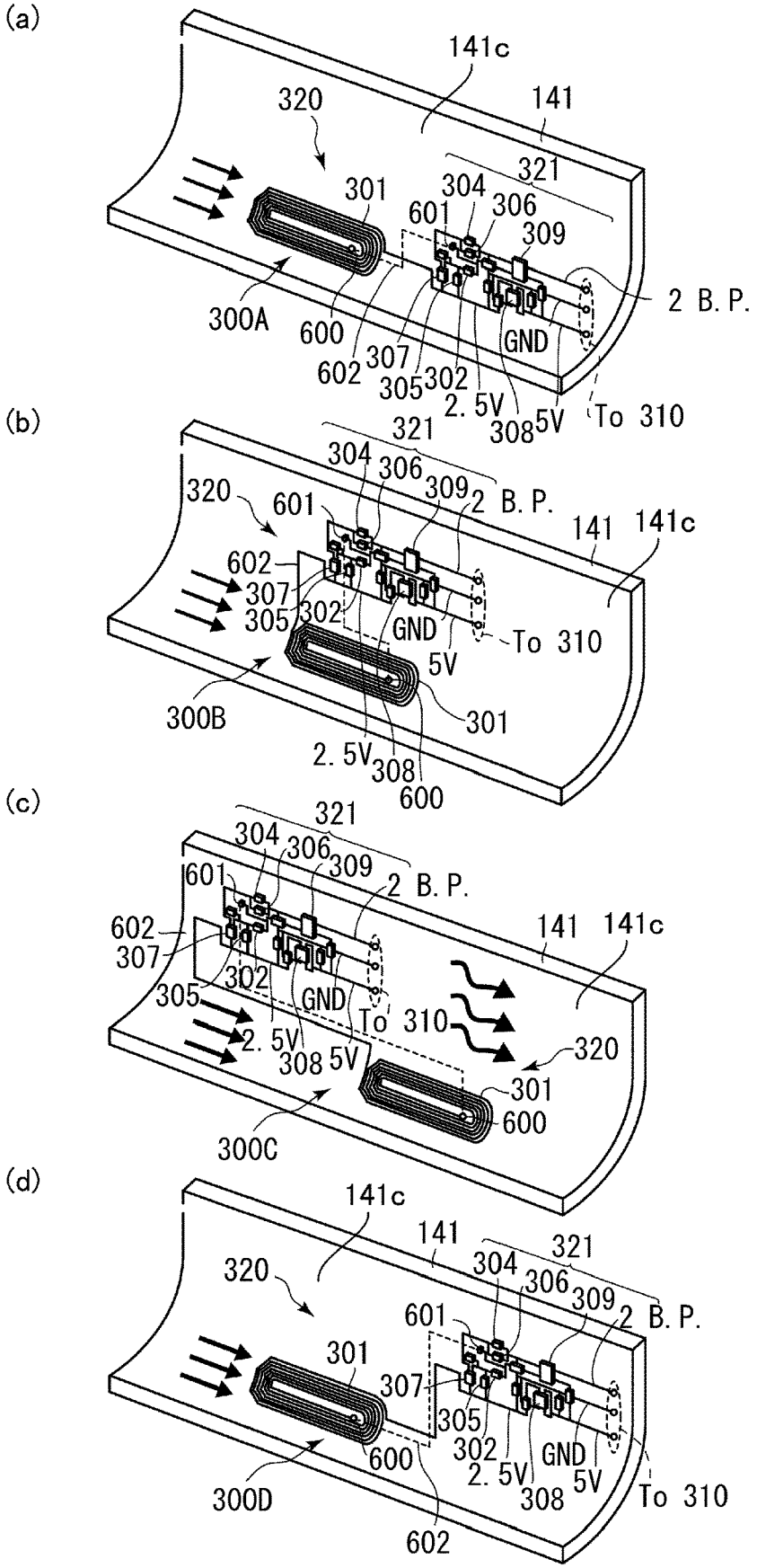

Parts (a) to (d) of FIG. 8 are perspective views showing only portions of developer containers according to a first example, a second example, a third example, and a fourth example, respectively, of the second embodiment, where the coil pattern and the circuit portion are formed.

Figure 9:
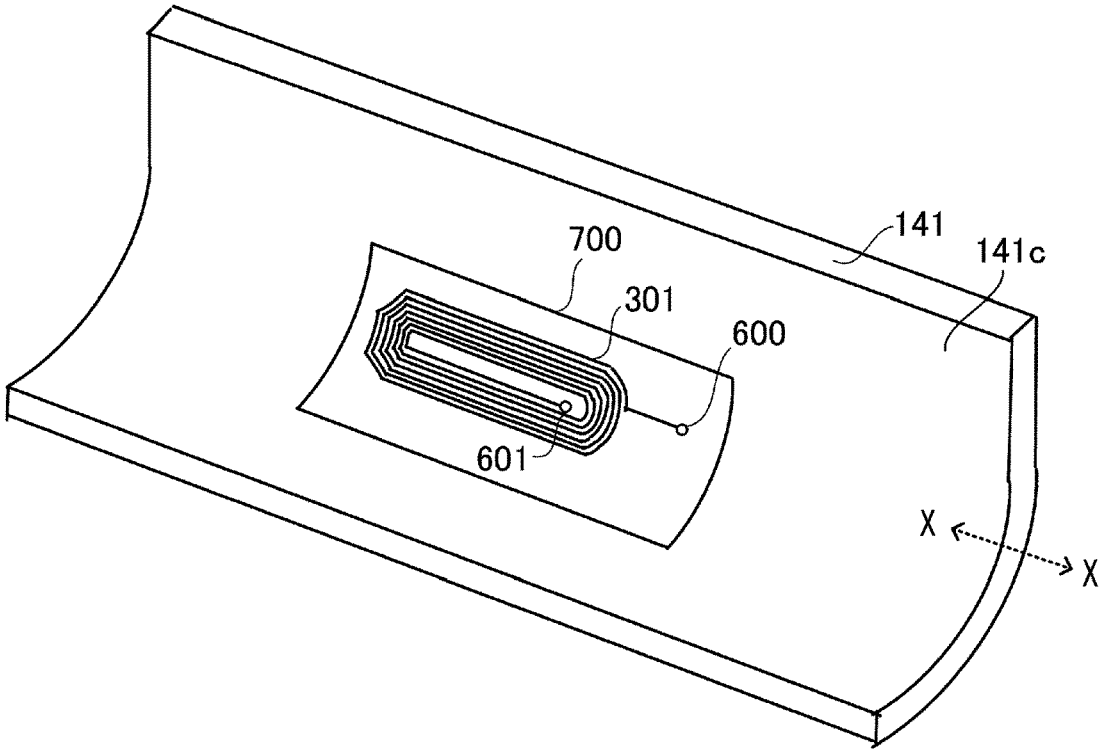

FIG. 9 is a perspective view showing only a portion of a developer container according to a third embodiment, where a coil pattern is formed.

Figure 10:
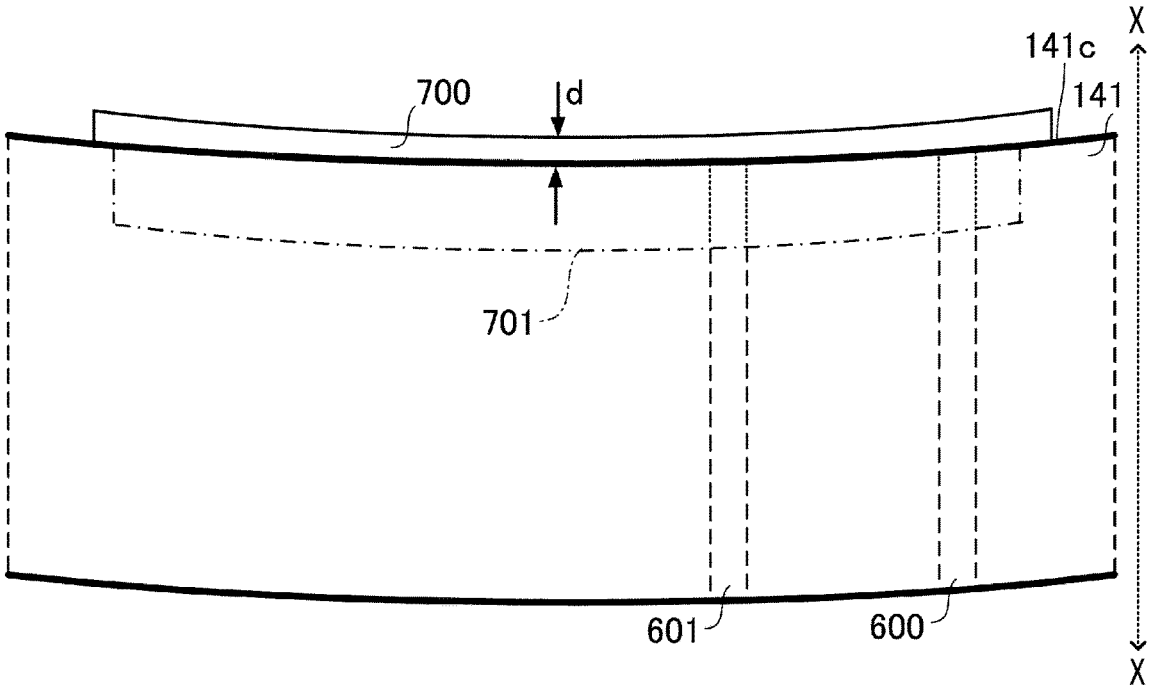

FIG. 10 is a sectional view showing a first example of a portion of the developer container according to the third embodiment, where the coil pattern is coated with a protective member.

Figure 11:
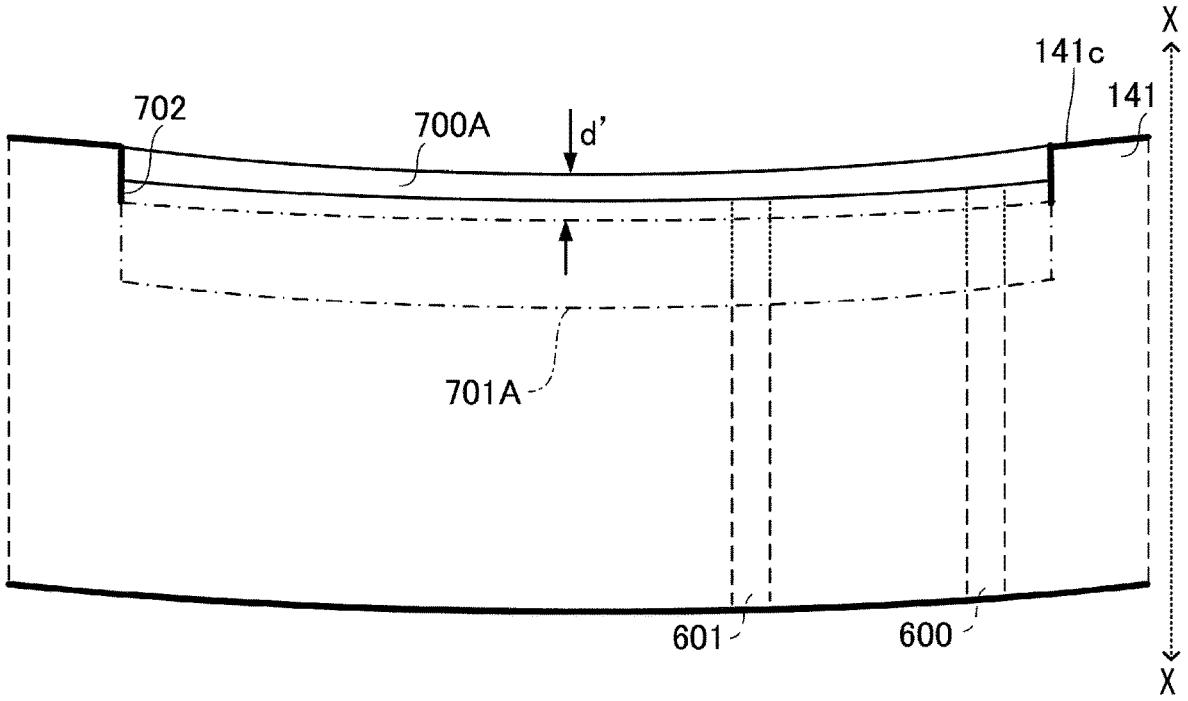

FIG. 11 is a sectional view showing a second example of the portion of the developer container according to the third embodiment, where the coil pattern is coated with the protective member.

Figure 12:
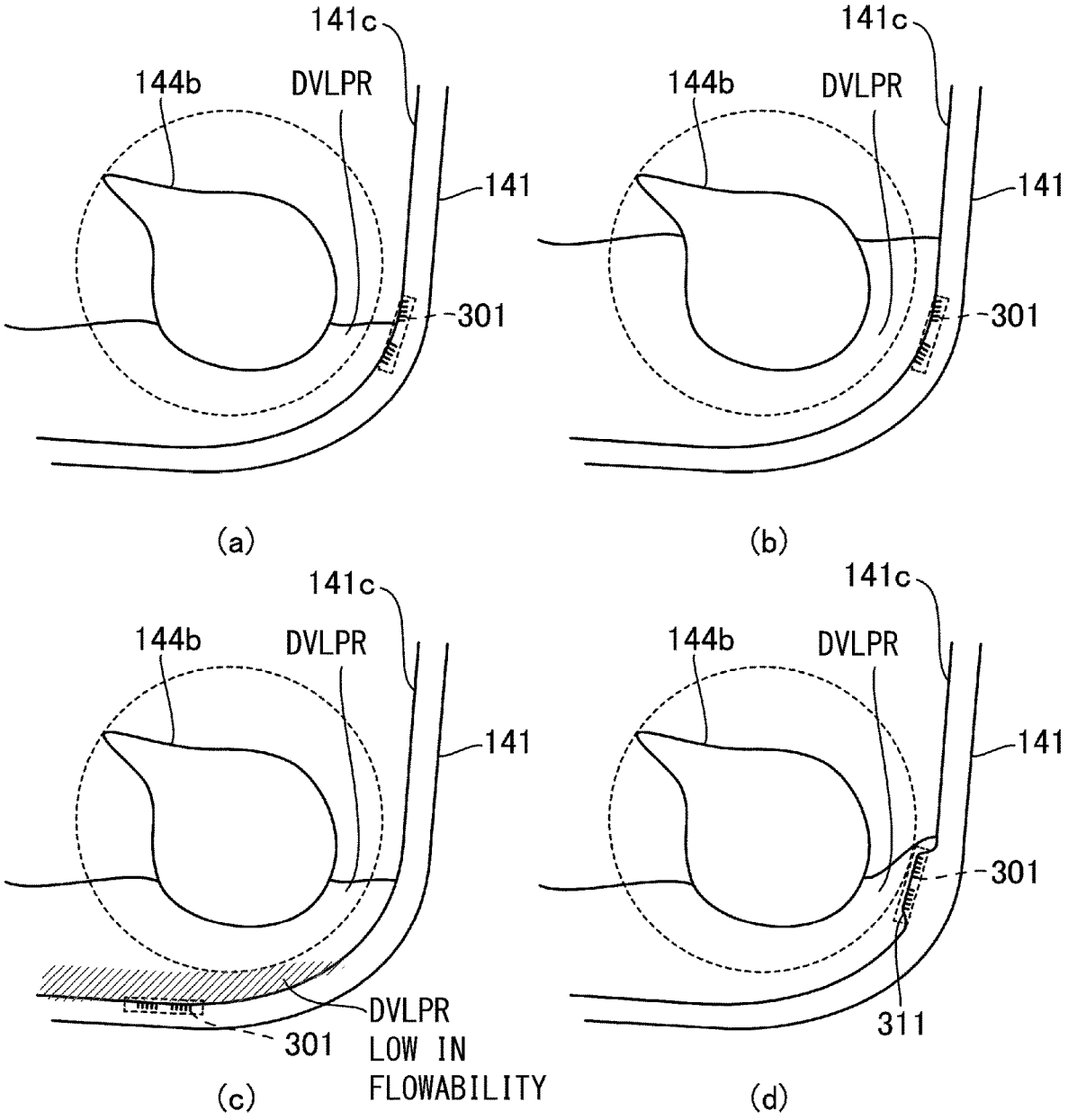

Parts (a) to (d) of FIG. 12 are schematic structural sectional views of developing devices each in the neighborhood a toner concentration detecting sensor in the case where an amount of a developer is small, the case where the amount of the developer is large, the case where the toner concentration detecting sensor is provided on a bottom of a developer container, and in the case of a fourth embodiment, respectively.

Figure 13:
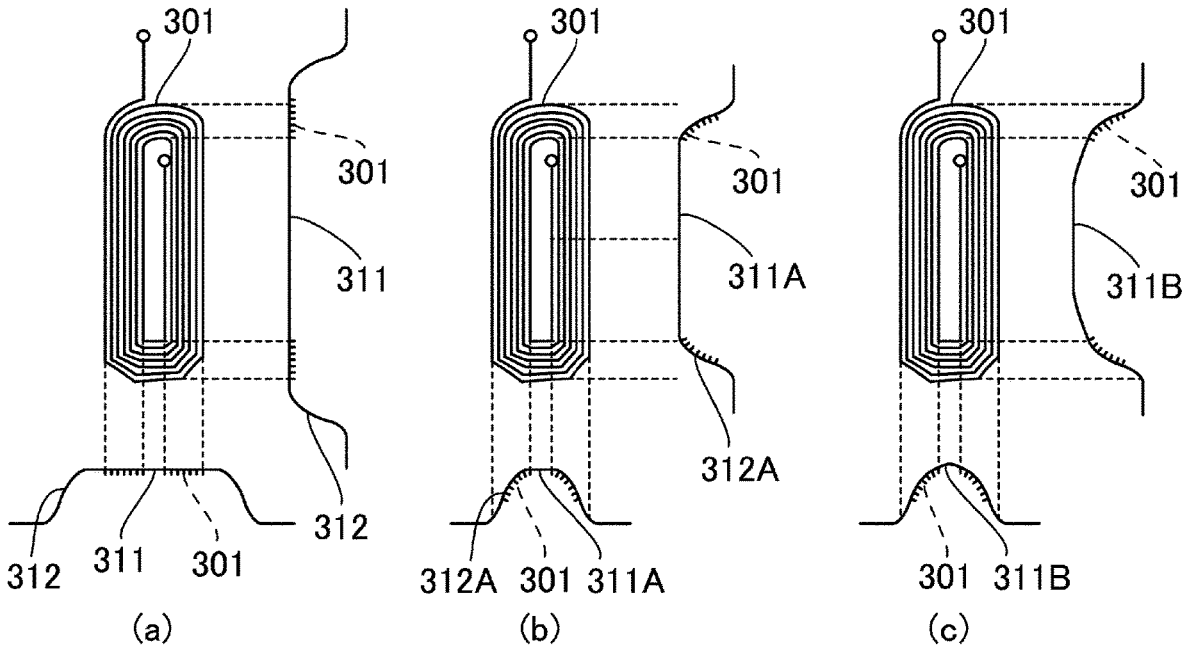

Parts (a) to (c) of FIG. 13 are top (plan) views and sectional views with respect to the two directions, showing a first example, a second example, and a third example, respectively, of a projected constitution in the neighborhood the toner concentration detecting sensor.

DESCRIPTION OF THE EMBODIMENTS

First Embodiment

A first embodiment will be described using FIGS. 1 to 6. First, a schematic structure of an image forming apparatus of this embodiment will be described using FIG. 1.

[Image Forming Apparatus]

An image forming apparatus 100 of this embodiment is a full-color printer including an image reading portion 1R for reading an image of an original and an image outputting portion 1P for outputting a read image on a recording material. That is, the image forming apparatus 100 optically reads the original image by the image reading portion and sends an image signal for each of color components to the image outputting portion 1P. In the image reading portion 1R, the original is placed on an original (supporting) platen, and when a copy button is pressed by a user, the original is irradiated with light from a light source, and the light reflected by the original is received by an image sensor 90 via a reflection mirror. The reflected light from the original received by the image sensor 90 is divided into beams of the reflected light for color components of R, G and B by a color filter, and on the basis of this signal, these light beams are converted into image signals for forming toner images of color components of yellow, magenta, cyan and black.

The image signals of these color components are inputted into exposure devices 13*a*, 13*b*, 13*c* and 13*d* corresponding to the respective color components of image forming portions 10*a*, 10*b*, 10*c* and 10*d* described later. In the image outputting portion P, the four image forming portions 10*a*, 10*b*, 10*c* and 10*d* are arranged in line. The image forming portion 10*a* forms a yellow toner image, the image forming portion 10*b* forms a magenta toner image, the image forming portion 10*c* forms a cyan toner image, and the image forming portion 10*d* forms a black toner image. The image forming portion 10*a* includes, around a photosensitive drum 11*a* as an image bearing member for bearing the yellow toner image, a charging device 12*a*, the exposure device 13*a*, a developing device 14*a*, a primary transfer roller 35*a*, and a drum cleaner 15*a*.

Here, the photosensitive drum 11*a* is a drum-shaped photosensitive member and is rotated in an arrow A direction. The charging device 12*a* charges the photosensitive drum 11*a*. Further, the exposure device 13*a* exposes this photosensitive drum 11*a* to light for forming an electrostatic latent image corresponding to a yellow component on the photosensitive drum 11*a* by inputting the above-described image signal corresponding to the yellow component into the exposure device 13*a*. Further, the developing device 14*a* visualizes, as a toner image, the electrostatic latent image formed on the photosensitive drum (image bearing member) 11*a*, by using a developer including toner. Further, the primary transfer roller 35*a* transfers the toner image of the yellow color component carried on the photosensitive drum 11*a*, onto an intermediary transfer belt 30 described later. Further, the drum cleaner 15*a* removes the toner remaining on the photosensitive drum 11*a*.

Incidentally, the image forming portions 10*b*, 10*c* and 10*d* have the same constitution as the image forming portion 10*a*. For this reason, in FIG. 1, description thereof will be omitted by replacing a suffix "a" representing each of constituent elements of the image forming portion 10*a* with a suffixes "b, c, d" representing each of constituent elements of the image forming portions 10*b*, 10*c* and 10*d*.

The above-described intermediary transfer belt 30 is an image bearing member for bearing the toner images, and forms a full-color toner image by superposedly carrying the toner images of the respective color components formed by the image forming portions 10*a*, 10*b*, 10*c* and 10*d*. Further, the intermediary transfer belt 30 is stretched around a driving roller 32 for rotationally driving the intermediary transfer belt 30, a follower roller 33, and a secondary transfer opposite roller 34 described later, and is rotationally driven in an arrow B direction of the figure by rotation of the driving roller 32. Incidentally, a portion where the primary transfer roller 35*a* presses the photosensitive drum 11*a* via the intermediary transfer belt 30 is referred to as a primary transfer nip Ta. Further, a portion where the primary transfer roller 35*b* presses the photosensitive drum 11*b* via the intermediary transfer belt 30 is referred to as a primary transfer nip Tb. Further, a portion where the primary transfer roller 35*c* presses the photosensitive drum 11*c* via the intermediary transfer belt 30 is referred to as a primary transfer nip Tc. Further, a portion where the primary transfer roller 35*d* presses the photosensitive drum 11*d* via the intermediary transfer belt 30 is referred to as a primary transfer nip Td.

Around the intermediary transfer belt 30, a secondary transfer roller 36 for transferring the toner images from the intermediary transfer belt 30 onto a recording material P is provided. Incidentally, as the recording material P, for example, it is possible to cite a sheet such as paper or a plastic sheet. Further, a portion where the secondary transfer roller 36 presses the secondary transfer opposite roller 34 via the intermediary transfer belt 30 is referred to as a secondary transfer nip Te. Further, a belt cleaner 50 for removing toner remaining on the intermediary transfer belt 30 without being transferred from the intermediary transfer belt 30 onto the recording material P is provided.

The recording material P is subjected to correction of oblique movement by being fed to a registration roller pair 23 from a cassette 20, via a feeding passage 22, accommodating recording materials P, or from a manual feeding tray 21. Then, the recording material P is fed from the registration roller pair 23 by being timed to the toner image on the intermediary transfer belt 30, so that the toner image is transferred from the intermediary transfer belt 30 onto the recording material P at the secondary transfer nip Te. The recording material P on which the toner image is transferred is fed to a fixing device 40. The fixing device 40 includes a heating roller 41*a* including therein a heating source such as a halogen heater and a pressing roller 41*b* for forming a fixing nip between itself and the heating roller 41*a*.

The recording material P is heated and pressed when the recording material P passes through the fixing nip, so that the toner image is fixed on the recording material P. The recording material P after the fixing is discharged on a discharge tray 24.

[Developing Device]

Figure 1:
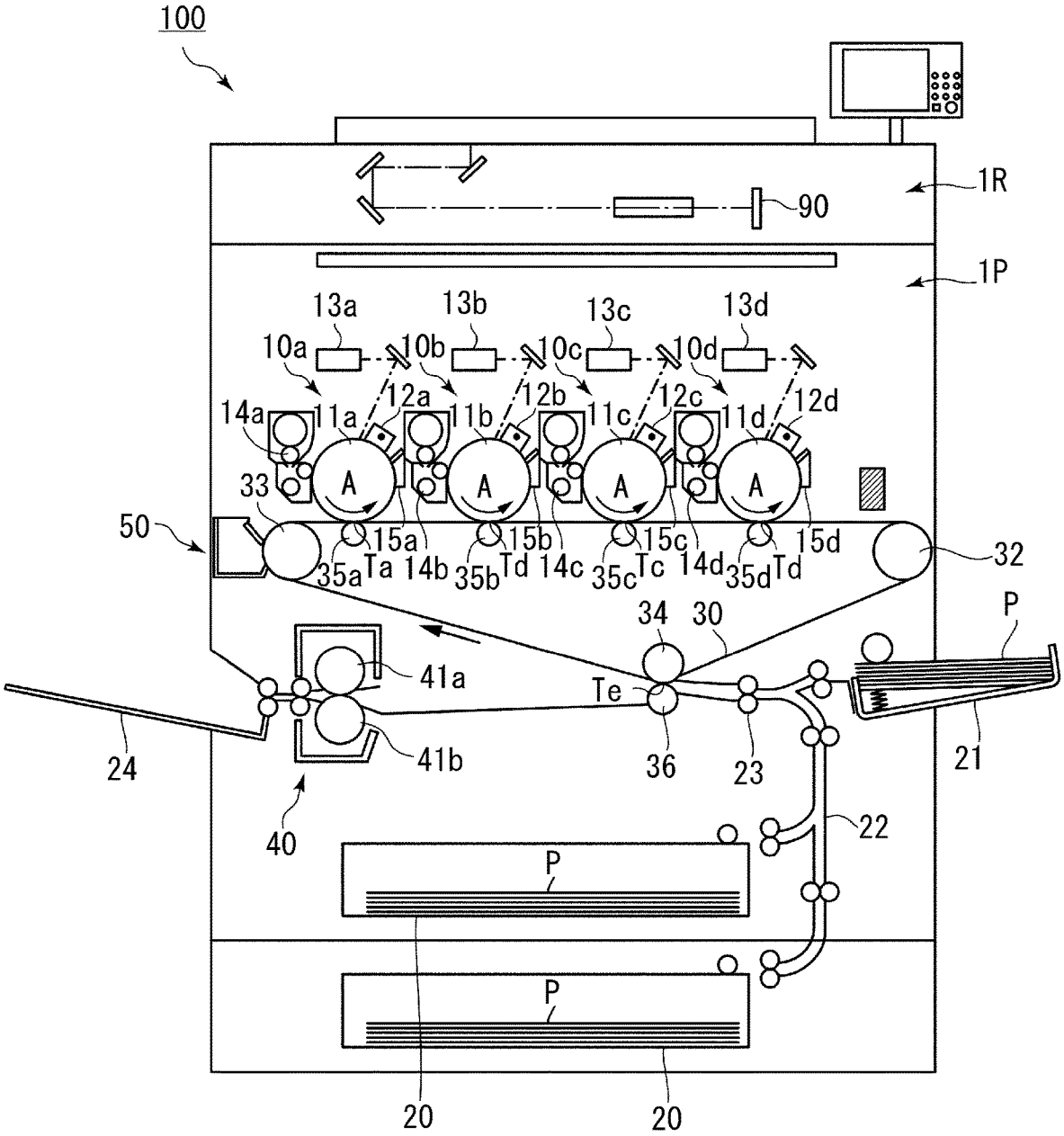
FIG. 1 is a schematic structural sectional view of an image forming apparatus according to a first embodiment.
Figure 2:
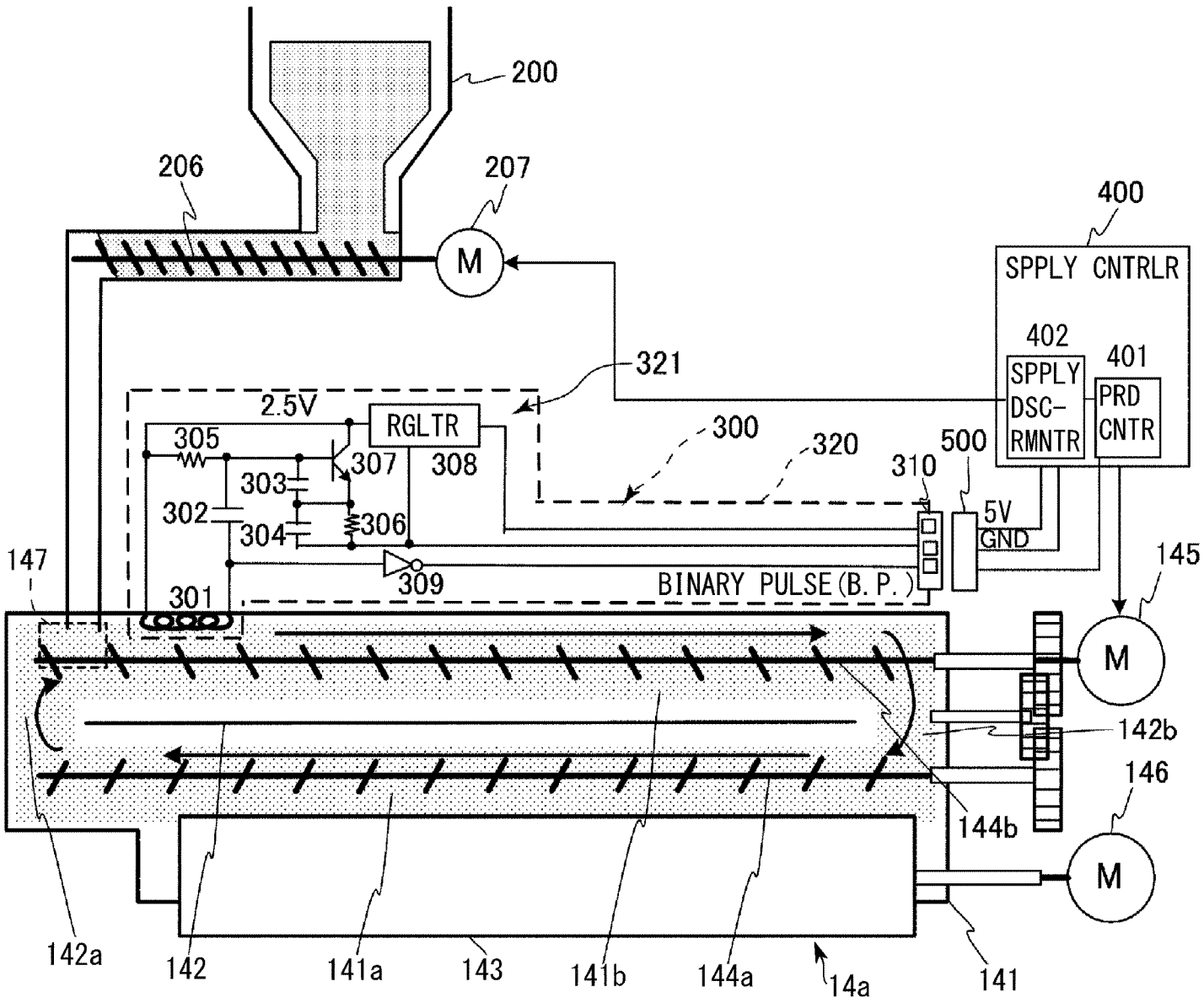
FIG. 2 is a schematic view showing a developing device according to the first embodiment, a developer supplying constitution, and a circuit relating to toner concentration detection.

Next, the developing devices 14*a*, 14*b*, 14*c* and 14*d* provided in the image forming apparatus of this embodiment and a toner concentration control device principally constituted by a toner concentration detecting sensor 300 will be specifically described. FIG. 2 is a schematic constitutional view showing a relationship between the developing device 14*a* and the toner concentration control device as a representative example. A developer supplying mechanism in this embodiment has a constitution in which the developer is supplied from a toner bottle (not shown), mounted in an apparatus main assembly so as to be exchangeable, to the developing device 14*a* via a hopper 200 as an accumulating container for temporarily accumulating the developer. In FIG. 2, for convenience, the hopper 200 is shown in a state in which the hopper 200 is viewed from a lateral side, and the developing device 14*a* is shown in a state in which the developing device 14*a* is viewed from above.

The developing device 14*a* includes a developer container 141 accommodating a two-component developer containing non-magnetic toner and a magnetic carrier, a developing sleeve 143 as a developer carrying member, and feeding screws 144*a* and 144*b*. The developer container 141 is formed by a resin material high in hardness, such as ABS resin acrylonitrile-butadiene-styrene copolymer (synthetic resin) or ABS/PC (polycarbonate). Further, the developer container 141 includes a developing chamber 141*a* as a first chamber and a stirring chamber 141*b* as a second chamber which are partitioned by a partition wall 142 provided so as to extend in a longitudinal direction (substantially parallel to a rotational axis direction of the developing sleeve 143 described above). At opposite end portions of the partition wall 142 with respect to the longitudinal direction, communication portions (openings) 142*a* and 142*b* for establishing communication between the developing chamber 141*a* and the stirring chamber 141*b* are formed. Further, as shown by arrows in FIG. 2, a circulating passage of the developer is formed between the developing chamber 141*a* and the stirring chamber 141*b*.

The developing sleeve 143 is disposed so that the rotational axis direction thereof is substantially parallel to a rotational axis direction of the photosensitive drum 11*a* (FIG. 1), and feeds the carried developer to an opposing portion to the photosensitive drum 11*a* by being rotated. Inside the developing sleeve 143, an unshown magnet is provided, and the developer is carried on a surface of the developing sleeve 143 by a magnetic attracting force of the magnet.

The feeding screw 144*a* is disposed in the developing chamber 141*a* along the longitudinal direction, and feeds the developer in the developing chamber 141*a* while stirring the developer. The developer fed by the feeding screw 144*a* is supplied to the developing sleeve 143.

The feeding screw 144*b* as a feeding member is disposed in the stirring chamber 141*b* along the longitudinal direction, and feeds the developer in the stirring chamber 141*b* while stirring the developer. On a side upstream of the stirring chamber 141*b* with respect to a developer feeding direction by the feeding screw 144*b*, a supply opening 147 through which the developer is supplied from the hopper 200 is formed. The feeding screw 144*b* feeds the developer in a direction opposite to the feeding direction by the feeding screw 144*a* while stirring the developer sent from the developing chamber 141*a* and the developer supplied through the supply opening 147.

In this embodiment, a constitution in which the two feeding screws 144*a* and 144*b* are rotationally driven by a driving motor 145 via gears. The driving motor 145 is driven and controlled by a developer supply controller 400 described later. On the other hand, the developing sleeve 143 is rotationally driven by a driving motor 146. The driving motor 146 is driven and controlled by an unshown motor controller.

The toner concentration detecting sensor 300 detects a toner concentration in the developer container 141. In FIG. 2, the toner concentration detecting sensor 300 is formed inside a side surface of the developing device in a state in which a coil which is a detecting portion thereof is drawn in a lead wire pattern (i.e., a coil pattern 301). The toner concentration detecting sensor 300 is formed on a side wall of the developer container 141 on a stirring chamber 141*b* side. Further, at least the coil pattern 301 is disposed on a side upstream of a center of the stirring chamber 141*b* with respect to a developer feeding direction and is disposed on a side downstream of the communication portion 142*b* for sending the developer from the supply opening 147 and the developing chamber 141*a* to the stirring chamber 141*b* with respect to the developer feeding direction. Further, the feeding screw 144*b* in the stirring chamber 141*b* includes a helical blade, around a rotation shaft, for feeding the developer, but at a position opposing the coil pattern 301, a rib projecting outwardly from the rotation shaft with respect to a radial direction is formed by cutting away this blade. By this, a stirring property of the developer in the neighborhood the coil pattern 301 is enhanced.

Incidentally, detailed description of the toner concentration detecting sensor 300 will be described later.

In such a developing device 14*a*, when the developer in the developer container 141 is stirred and fed by the feeding screws 144*a* and 144*b*, the toner is electrostatically attracted to the carrier as a magnetic material. This carrier on which the toner is deposited is carried on the developing sleeve 143 by a magnetic force from an unshown magnet, and develops the electrostatic latent image into the toner image, so that only the toner is consumed.

[Tone Concentration Detecting Sensor]

The toner concentration detecting sensor 300 comprises constituent elements enclosed by a broken line in FIG. 2. That is, the toner concentration detecting sensor 300 includes the coil pattern 301 constituting a resonance circuit 320 in which inductance changes depending on the toner concentration and includes a circuit portion (driving circuit) 321 constituting the resonance circuit 320 in cooperation with the coil pattern 301. The circuit portion 321 includes parts, of the resonance circuit 320, other than the coil pattern 301 and a lead wire pattern connecting these parts, and is disposed outside the side surface of the developer container 141.

The toner concentration detecting sensor 300 is contactable to a contact point 500 provided on a back surface of the apparatus main assembly, and a voltage of 5 V and the ground voltage (GND) are supplied from the developer supply controller 400 via a contact point 310 provided at an end portion of the developing device 14*a* with respect to the longitudinal direction. The supplied voltage of 5 V is converted to a voltage of 2.5 V by a regulator 308. The coil pattern 301, capacitors 302, 303 and 304, resistors 305 and 306, and a transistor 307 form an oscillation circuit of Colpitts type.

This oscillation circuit oscillates a signal with a predetermined amplitude about the voltage of 2.5 V. That is, the oscillation circuit includes the resonance circuit (LC oscillation circuit) constituted by the coil pattern 301 and the circuit portion 321 including the capacitors 302, 303 and 304, and oscillates a signal (oscillation signal) for detecting the toner concentration in the developer container 141. The oscillation signal is binarized by an inverter 309 and is outputted as a rectangular pulse to the developer supply controller 400 via the contact points 310 and 500. In this embodiment, a portion, to the contact point 310, from a connecting portion, with the coil pattern 301, including the capacitors 302, 303 and 304, the resistors 305 and 306, the transistor 307, the regulator 308, the inverter 309, and lead wires connecting these parts constitute the circuit portion 321. Further, the circuit portion 321 and the coil pattern 301 constitute the resonance circuit 320.

In the case where a magnetic material does not exist at a periphery of the circuit, when inductance of the coil pattern 301 is L and capacitance of the capacitors 302, 303 and 304 is C, a resonance period T of this resonance circuit 301 is represented by the following formula.

$$T = 2\pi\sqrt{\frac{LC}{3}}$$

The carrier in the developer is the magnetic material, and when relative permeability of the developer is μs, the inductance when the coil detects the developer changes from L to μsL. The resonance period T at this time is represented by the following formula.

$$T = 2\pi\sqrt{\frac{\mu sLC}{3}}$$

As regards the developer accumulated in the developing device 14, when the toner in the developer is consumed by development of the electrostatic latent image with the toner, an amount of the carrier which is the magnetic material relatively becomes large, and therefore, relative permeability as the developer becomes high, so that the resonance period T becomes long. On the other hand, when the amount of the toner in the developer is increased by supplying the developer, very high in toner ratio, from the hopper 200, the amount of the carrier as the magnetic material relatively becomes small, and therefore, the relative permeability as the developer becomes low, so that the resonance period T becomes short.

A binarized pulse, from the toner concentration detecting sensor 300, which thus changes in period T is counted with a clock shorter in period than the binarized pulse, by a period counter 401. The period counter 401 temporarily stores the counted value in a period count value register, and then outputs count data, stored in the period count value register, to a supply discriminating portion 402.

Then, the supply discriminating portion 402 discriminates that a carrier concentration in the developer becomes high by consumption of the toner in the case where the count data inputted from the period counter 401 is larger than a developer supply discrimination level. Then, a screw 206 is rotated via a motor 207, so that the developer high in toner concentration is supplied from the hopper 200.

Figure 3:
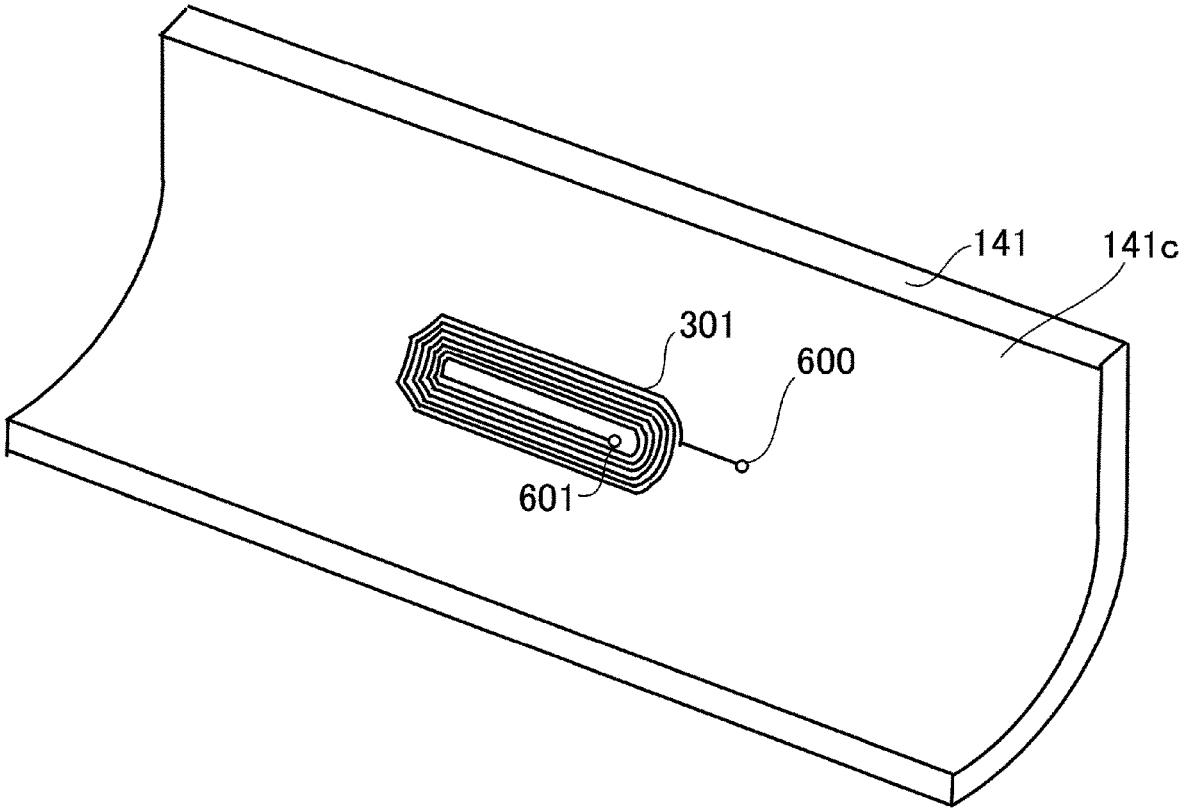
FIG. 3 is a perspective view showing only a portion of a developer container according to the first embodiment, where a coil pattern is formed.

In this embodiment, as regards the toner concentration detecting sensor 300, at least the coil pattern 301 is formed integrally with the developer container 141 by a metal film (for example, a copper foil) so that the coil pattern 301 is positioned on an inner wall surface 141*c* of the developer container 141. Specifically, as shown in FIG. 3 described below, the coil pattern 301 is disposed on the inner wall surface 141*c* of the developer container 141, and as shown in FIG. 6 described later, the circuit portion 321 is disposed on an outer wall surface 141*d* of the developer container 141.

[Coil Pattern]

Next, a method in which a copper film pattern having a coil shape is formed as the coil pattern 301 on an inside of the wall surface of the developer container 141 will be described. FIG. 3 is a perspective view showing a state in which the coil pattern 301 which is a detecting portion of the toner concentration detecting sensor 300 is formed as a copper foil pattern on the inner wall surface 141*c* of the developer container 141.

A structure of the resonance circuit portion, other than the coil pattern 301, i.e., the circuit portion 321 is mounted in the form such that the circuit portion 321 is connected by the copper foil pattern formed outside the wall surface of the developing device 14. Further, the circuit portion 321 is connected to the coil pattern 301 via through holes 600 and 601.

Here, the coil pattern 301 and the circuit portion 321 which are described above are formed by a metal film integrally with the developer container 141 made of a resin material. That is, the copper foil pattern in the coil pattern 301 and the circuit portion 321 is formed by a method of construction which is called MID. The MID is an abbreviation of "Molded Interconnect Device", and is capable of molding circuit wiring, as a substitute for a conventional printed board, on a resin casing.

This construction technique enables not only rationalization of the wiring but also downsizing and surface molding of electronic device parts or the like. For example, by disposing the MID in a gap in a device, an integration density can be improved. The MID is applied to a semiconductor package such as a light emitting diode (LED), a three-dimensional printed circuit board, an antenna part for a mobile phone, and the like.

A manufacturing method of the MID is roughly divided into a "one-shot molding method" and a "two-shot molding method". In the one-shot molding method, a molded product is prepared using a plating-grade resin material by injection molding, and the molded product is roughened at an entire surface thereof, and thereafter, a catalyst is added, and then, a copper-plated film is formed. Then, a resist is applied onto the copper-plated film, and a circuit is formed by photolithography. As a circuit forming method, a subtractive method using an etching resist, a semi-additive method using a plating resist, and the like method exist.

In the one-shot molding method, in an exposure step to a resist film, the resist film is exposed to parallel light, and therefore, it is difficult that a circuit is formed on a perpendicular surface. Even when a method in which molding is made so that a shape of a mask conforms to a shape of the molded product is employed, there arises a problem such that there is a limit to a moldable mask shape and that the mask shape is limited to a shape of a mask capable of being irradiated uniformly with exposure light beam. Accordingly, the one-shot molding method is low in degree of freedom of formation of an electroconductive circuit. Further, in the one-shot molding method, the circuit is formed by etching, and therefore, it is difficult that a thickness of the electroconductive is made large.

The two-shot molding method is a method in which an integral molded product is prepared through molding of two shots by using two kinds of resin materials consisting of an easily platable resin material and a hardly platable resin material, and then a circuit is formed by a full-additive method. Specifically, the easily platable resin material is subjected to injection molding, so that a primary-molded product is prepared, and a catalyst is imparted to a surface of the primary-molded product. Or, a primary-molded product is prepared by subjecting an easily platable resin material containing a catalyst in advance, to the injection molding. Then, on an entire surface of a portion other than a portion where a circuit of the primary-molded product should be formed, the hardly platable resin material is prepared by the injection molding, so that a secondary-molded product including a layer coated with the hardly platable resin material is formed. The layer coated with the hardly platable resin material performs a function of a plating resist during the plating. Finally, a portion of the surface of the primary-molded product where the circuit should be formed is subjected to the plating by the full-additive method.

According to the two-shot molding method, the circuit can also be easily formed on the perpendicular surface, and therefore, a three-dimensional circuit molding which was impossible or difficult in the one-shot molding method can be easily carried out. In the two-shot molding method, the thickness of the electroconductive can also be made larger than in the one-shot molding method using the etching because of use of the full-additive method, so that a circuit part large in allowable current can be prepared.

The forming method of the coil pattern 301 and the circuit portion 321 in this embodiment may be either one of the one-shot molding method and the two-shot molding method. Further, the coil pattern 301 and the circuit portion 321 are formed in a resin part having a predetermined shape by, for example, the method of construction of the MID, and then may also be prepared integrally with another portion of the developer container 141. In this case, the surface of the resin part where the coil pattern 301 is formed constitutes the inner wall surface 141*c* of the developer container 141. Incidentally, the coil pattern 301 and the circuit portion 321 may also be directly formed on the developer container 141 of the method of construction of the MID. Further, a modified example in which a portion of the developer container 141 having a surface of a resin pattern where the coil pattern 301 is formed and another portion of the developer container 141 are separately subjected to resin molding into separate parts, and thereafter, these molded parts are connected to each other by welding or the like, and are completed as the developer container 141 may also be used.

Parts (a) and (b) of FIG. 4 are sectional views of developing devices in the neighborhood detection ranges of toner concentration detecting sensor 300 in a comparison example and this embodiment (First embodiment), respectively. Further, FIG. 5 is a relative value characteristic graph in which a fluctuation of a resonance period depending on a distance characteristic between the coil pattern 301 of the resonance circuit and an object of a magnetic material to be detected is represented as sensitivity.

As shown in part (a) of FIG. 4, in a constitution of the comparison example, a toner concentration detecting sensor 800 in which a coil pattern 301 and a circuit portion 321 are formed on a printed board is provided on the outer wall surface 141*d* of the developer container 141. In such a comparison example, the coil pattern 301 is formed on the outer wall surface 141*d*, and therefore, the developer is detected (in a non-contact state with the developer in the developer container 141) through a resin wall of the developer container 141. For this reason, the coil pattern 301 detects the developer with a distance of, for example, about 2 mm corresponding to a thickness of the wall of the developer container 141.

Here, as apparent from FIG. 5, in the case where a distance between the object to be detected (the developer in this case) and the coil pattern 301 is 2 mm, compared with the case where the distance between the object to be detected and the coil pattern 301 is 0 mm (i.e., in a contact state between the coil pattern 301 and the developer), the sensitivity lowers by 80%. That is, the detection sensitivity lowers with an increasing distance between the coil pattern 301 and the developer which is the object to be detected. By this, relative to a change in toner concentration, a changer per (one) period of the LC resonance of the resonance circuit 320 becomes dull. For this reason, in the case where the coil pattern 301 is provided on the outer wall surface 141*d* of the developer container 141, it is understood that the developer is not readily detected at high sensitivity.

Incidentally, in order to enhance resolution of detection of the toner concentration, it would be also considered that the number of LC resonance cyclic periods of the object to be detected is increased for prolonging a detection measurement period, but in this case, a timewise detecting rate lowers. That is, a time until a detection result is determined. Further, when the wall of the developer container 141 expands by the influence of an environmental temperature, the distance between the coil pattern 301 and the developer fluctuates. For this reason, in the case where the coil pattern 301 is provided on the outer wall surface 141*d* of the developer container 141, the expansion of the wall of the developer container 141 due to the environmental temperature has the influence on a detection result of the toner concentration.

On the other hand, in this embodiment, as shown in part (b) of FIG. 4, the coil pattern 301 is formed on the inner wall surface 141*c* of the developer container 141. For this reason, the coil pattern 301 is capable of detecting the developer (in a contact state with the developer in the developer container) without passing through the resin wall of the developer container 141. Accordingly, as shown in FIG. 5, at a position of a distance of 0 mm, it is possible to detect a fluctuation of a carrier ratio in the developer, i.e., a change in toner concentration with good sensitivity. Further, even when the wall of the developer container 141 expands by the influence of the environmental temperature, a distance relationship with the developer does not change, so that the environmental temperature has no influence on the detection result.

Further, it would be also considered that a board on which the coil pattern 301 is formed is provided on the inner wall surface 141*c* of the developer container 141. In this case, the coil pattern 301 can be contacted to the developer, and therefore, detection sensitivity can be improved than the case where the coil pattern 301 is provided on the outer wall surface 141*d*. However, when the board is mounted on the inner wall surface 141*c* of the developer container 141, a mounting tolerance occurs, and therefore, there is a possibility that the position of the coil pattern 301 is deviated from a desired position and has the influence on detection accuracy.

For example, in the case where a constitution in which a recessed portion is formed on the inner wall surface 141*c* of the developer container 141 and in which the board on which the coil pattern 301 is formed is mounted in the recessed portion is employed, there is a possibility that the position of the coil pattern 301 is deviated in the recessed portion due to a tolerance. For example, when the coil pattern 301 is provided so as to be positioned on a flat surface substantially flush with the inner wall surface 141*c* other than the recessed portion, the coil pattern 301 can be provided at a position where the developer flows. However, in the case where the coil pattern 301 is positioned inside the recessed portion relative to this flat surface, the developer stagnates in the recessed portion in the neighborhood the coil pattern 301, so that the change in toner concentration is not readily detected. Further, even if the coil pattern 301 can be disposed on the same flat surface described above, between an inner wall of the recessed portion and the board, there is a gap for permitting mounting of the board, and therefore, the developer enters this gap. Then, the developer does not flow and easily stagnates in this gap continuously, so that there is a liability that the developer has the influence on the detection of the toner concentration by the coil pattern 301.

On the other hand, in the case where the board on which the coil pattern 301 is mounted on the inner wall surface 141*c* of the developer container 141 without providing the recessed portion on the inner wall surface 141*c*, due to the tolerance, there is a possibility that the distance from the feeding screw changes.

For example, at a position where the toner concentration detecting sensor is disposed, a rib for stirring, not a screw portion of the feeding screw is provided in some cases. The coil pattern 301 is provided at a position where the developer flows to the extent possible, so that detection sensitivity to the change in toner concentration is improved, and therefore, the coil pattern 301 may preferably be disposed close to the rib to the extent possible at a position where the coil pattern 301 does not contact the rib for stirring. However, when the mounting tolerance of the board to the inner wall surface 141*c* of the developer container 141 is taken into consideration, the board is not readily provided close to the rib in design, and therefore, the board is disposed away from the rib. Then, the coil pattern 301 is liable to be disposed at a place where flowability of the developer is low, so that the detection sensitivity is not readily improved.

On the other hand, as in this embodiment, in the case of a constitution in which the coil pattern 301 is formed on the inner wall surface 141*c* of the developer container 141 by the method of construction of the MID, there is no need to consider the mounting tolerance as described above. For this reason, at a proper position where the developer flows, the coil pattern 301 can be disposed so that the distance from the developer becomes substantially 0. Accordingly, according to the constitution of this embodiment, the detection accuracy of the toner concentration can be improved.

Further, conventionally, there was a constitution in which the toner concentration detecting sensor is provided as a separate member and a sensor detecting portion is exposed from an outer wall side to an inner wall side of the developer container via a penetrating portion and in which a circuit portion other than the detecting portion, or the like portion is accommodated in a case and is disposed on the outer wall side. Also, in the case of this constitution, as described above, there was a liability that the mounting tolerance occurs or that the expansion of the developer container due to the environmental temperature has the influence on the detection accuracy.

Further, in the case of this constitution, an installation place of a sensor for preventing an interference with an adjacent image forming portion was restricted. That is, an interval between adjacent image forming portions is narrowed for downsizing the apparatus. Further, the sensor detecting surface is desired to be disposed in a place where the flowability of the developer is good, and therefore, the sensor detecting surface may preferably be disposed on a side wall than on the bottom of the developer container. This is because the developer in the neighborhood of the bottom of the developer container tends to stagnate by a self-weight thereof and thus is lower in flowability than the developer in the neighborhood of the side wall of the developer container. However, in the case of the conventional toner concentration detecting sensor, there is a portion projected on the outer wall side, and thus there was a liability that when the toner concentration detecting sensor is provided on the side wall, the toner concentration detecting sensor interferes with an adjacent image forming portion. For this reason, the sensor is disposed at a corner (for example, at a position of obliquely 45°) between the side wall and the bottom, whereby not only interference with the adjacent image forming portion was prevented but also the sensor detecting surface was disposed at a position where flow ability was good.

On the other hand, in the case of this embodiment, the coil pattern 301 is formed integrally with the inner wall surface 141*c* of the developer container 141 by the method of construction of the MID. For this reason, different from the conventional constitution, a degree of freedom is not restricted, so that for example, the coil pattern 301 can be disposed at a position of the side wall of the container where the flowability is good. At this time, as regards the circuit portion 321, even if a constitution in which the circuit portion 321 is formed separately on a board and in which the board is mounted on the developer container 141 is employed, wiring to the circuit portion 321 is formed by the method of construction of the MID and can be disposed at a position where the wiring does not readily interfere with the image forming portion to which the circuit portion 321 is adjacent. Further, as described below, when the circuit portion 321 is also formed integrally with the developer container 141, irrespective of a distance from the adjacent image forming portion, the circuit portion 321 can also be disposed at a free position, so that a degree of freedom of design is further improved.

[Circuit Portion]

Next, the circuit portion 321 will be described using FIG. 6. FIG. 6 is a perspective view showing a state in which the circuit portion 321 which is a circuit constitution other than the coil pattern 301 of the toner concentration detecting sensor 300 is formed on an outside of the wall surface of the developing device 14*a*. As described above, the circuit portion 321 is disposed on the outer wall surface 141*d* of the developer container 141.

Connection to the coil pattern 301 formed inside the wall surface is established via the through holes 600 and 601. In order to prevent the developer from leaking from the inside toward the outside of the developer container 141 via the through holes 600 and 601, it is preferable that the through holes 600 and 601 are closed by a sealing member.

Chip parts indicated by reference numerals or symbols in the figure are the same parts as those represented by the reference numerals or symbols in FIG. 2. From the end portion contact 310, the 5V line and the GND line are supplied, and the binarized pulse signal of the resonance signal depending on the detection results sent to the end portion contact 310. The pattern forming the circuit portion 321 is formed by the MID similarly as the coil pattern 301. Thus, the circuit is formed on the outside of the wall surface, whereby it is possible to prevent short circuit due to the carrier which is the magnetic material.

Second Embodiment

A second embodiment will be described using FIG. 7 to part (d) of FIG. 8. In the above-described first embodiment, the constitution in which the circuit portion 321 was disposed on the outer wall surface 141*d* of the developer container 141 was described. On the other hand, in this embodiment, the circuit portion 321 is disposed on the inner wall surface 141*c* of the developer container 141. Other constitutions and actions are similar to those in the above-described first embodiment, and therefore, similar constituent elements are represented by the same reference numerals or symbols, and will be omitted from illustration and description or will be briefly described. In the following, a point different from the first embodiment will be principally described. FIG. 7 and parts (a) and (d) of FIG. 8 are perspective views each showing a state in which a circuit portion 321 which is a circuit constitution other than a coil pattern 301 of a toner concentration detecting sensor is formed on an outside of the wall surface of the developing device 14*a*. Directions in which the developer is fed by the unshown feeding screw 144*b* in the developing device are indicated by arrows in FIG. 7 and parts (a) to (d) of FIG. 8. Incidentally, FIG. 7 shows a positional relationship between the coil pattern 301 and the circuit portion 321 in a reference example of this embodiment, and parts (a) to (d) of FIG. 8 show positional relationships each between the coil pattern 301 and the circuit portion 321 in first to fourth examples, respectively, of this embodiment.

Connection between the coil pattern 301 and the circuit portion 321 on the inside of the wall surface is established via the through holes 600 and 601, and the wiring pattern 602. The wiring pattern 602 connects one end portion (inside in the example of each figure) of a wire-wound coil pattern 301 and the circuit portion 321 by causing wiring to once pass through the outer wall side. The other end portion (outside in the example of each figure) of the wire-wound coil pattern 301 is connected along the inner wall surface 141*c* of the developer container 141.

Chip parts indicated by reference numerals or symbols in the figures are the same parts as those represented by the reference numerals or symbols in FIG. 2. From the end portion contact 310, the 5V line and the GND line are supplied, and the binarized pulse signal of the resonance signal depending on the detection results sent to the end portion contact 310. The pattern forming the circuit portion 321 is formed by the MID similarly as the coil pattern 301.

As regards a toner concentration detecting sensor 800A according to the reference example of FIG. 7, with respect to the developer feeding direction of the feeding screw 144*b*, the circuit portion 321 is disposed upstream of the coil pattern 301. In this case, due to unevenness of respective component parts constituting the circuit portion 321, disorder generates in flow of the developer as indicated by wavy arrows in FIG. 7. When the developer in this state passes through the neighborhood of the coil pattern 301, sparse/dense of the developer occurs in the neighborhood the coil pattern 301, so that stable toner concentration detection is not readily carried out. For this reason, in this embodiment, the circuit portion 321 is disposed as shown in each of parts (a) to (d) of FIG. 8.

First, as regards a toner concentration detecting sensor 300A according to the first example of part (a) of FIG. 8, with respect to the developer feeding direction of the feeding screw 144*b*, the circuit portion 321 is disposed downstream of the coil pattern 301. In this case, stable toner concentration detection can be carried out without disordering the flow of the developer in the neighborhood the coil pattern 301.

Next, as regards a toner concentration detecting sensor 300B according to the second example of part (b) of FIG. 8, the circuit portion 321 is disposed at a position (a side wall portion of the inner wall surface 141*c* of the developer container 141) away from the coil pattern 301 in the case where the toner concentration detecting sensor 300B is viewed in the developer feeding direction of the feeding screw 144*b*. In part (b) of FIG. 8, the coil pattern 301 is disposed at a position where the circuit portion 321 is adjacent to the coil pattern 301 with respect to a direction (lateral direction) perpendicular to the developer feeding direction. Also, in this case, the stable toner concentration detection can be carried out without disordering the flow of the developer in the neighborhood of the coil pattern 301.

Next, also, as regards a toner concentration detecting sensor 300C according to the third example of part (c) of FIG. 8, the circuit portion 321 is disposed at a position (a side wall portion of the inner wall surface 141*c* of the developer container 141) away from the coil pattern 301 in the case where the toner concentration detecting sensor 300B is viewed in the developer feeding direction of the feeding screw 144*b*. However, the circuit portion 321 is disposed upstream of the coil pattern 301 with respect to the developer feeding direction. That is, the circuit portion 321 is disposed upstream of the coil pattern 301 with respect to the developer feeding direction and at a lateral position. In this case, the stable toner concentration detection can be carried out without disordering the flow of the developer in the neighborhood of the coil pattern 301 because the position of the coil pattern 301 is offset in the lateral direction relative to the flow (wavy lines (arrows) in the figure) of the developer disordered by the circuit portion 321.

Further, also as regards a toner concentration detecting sensor 300D according to the fourth example of part (d) of FIG. 8, the circuit portion 321 is disposed at a position (a side wall portion of the inner wall surface 141*c* of the developer container 141) away from the coil pattern 301 in the case where the toner concentration detecting sensor 300B is viewed in the developer feeding direction of the feeding screw 144*b*. However, the circuit portion 321 is disposed downstream of the coil pattern 301 with respect to the developer feeding direction. That is, the circuit portion 321 is disposed downstream of the coil pattern 301 with respect to the developer feeding direction and at a lateral position. Also, in this case, the stable toner concentration detection can be carried out without disordering the flow of the developer in the neighborhood the coil pattern 301.

Thus, in this embodiment, the circuit portion 321 is disposed downstream of the coil pattern 301 with respect to the developer feeding direction, at a position deviated in the lateral direction, upstream of the coil pattern 301 with respect to the developer feeding direction and at the lateral position, and downstream of the coil pattern with respect to the developer feeding direction and at the lateral position. For this reason, even when the circuit portion 321 is disposed on the inner wall surface 141*c* of the developer container 141, it is possible to perform the stable toner concentration detection by suppressing the influence of the disorder of the flow of the developer at the circuit portion 321 on the toner concentration detection.

However, the constitution in which the circuit portion 321 and the coil pattern 301 are formed on the inner wall surface 141*c* of the developer container 141 is not limited to the above-described constitutions. That is, when the toner concentration detecting sensor provided from the viewpoint each that the circuit portion 321 is disposed at the position where the flow of the developer in the neighborhood the coil pattern 301 is not disordered, the arrangement of the circuit portion 321 and the coil pattern 301 is not limited to those of parts (a) t (d) of FIG. 8.

In the above-described first embodiment, the circuit portion 321 is disposed on the outer wall surface 141*d* of the developer container 141, and therefore, there is a need that the developer container 141 is provided with the through holes 600 and 601 for connecting the circuit portion 321 and the coil pattern 301. On the other hand, in the second embodiment, the circuit portion 321 is provided on the inner wall surface 141*c* of the developer container 141, and therefore, there is no need that the developer container 141 is provided with the through holes 600 and 601 for connecting the circuit portion 321 and the coil pattern 301. Therefore, the second embodiment is more advantageous than the first embodiment in that there is no need in the second embodiment to consider that the through holes 600 and 601 are closed by a sealing member so as to prevent the developer from leaking from the inside to the outside of the developer container 141 via the through holes 600 and 601.

On the other hand, in the second embodiment, the circuit portion 321 is disposed on the inner wall surface 141*c* of the developer container 141, and therefore, there is a need to dispose the circuit portion 321 relative to the coil pattern 301 so that the influence of the disorder of the flow of the developer at the circuit portion is suppressed. On the other hand, in the first embodiment, the circuit portion 321 is disposed on the outer wall surface 141*d* of the developer container 141, and therefore, the disorder of the flow of the developer at the circuit portion 321 does not originally occur. Therefore, the first embodiment is more advantageous than the second embodiment in that there is no need in the first embodiment to consider the influence of the disorder of the flow of the developer at the circuit portion 321 when the circuit portion 321 is disposed relative to the coil pattern 301 is suppressed.

Third Embodiment

A third embodiment will be described using FIGS. 9 to 11. In this embodiment, protective members 700 and 700A for covering (coating) the surface of the coil pattern 301 formed on the inner wall surface 141*c* of the developer container 141 are provided. Other constitutions and actions are similar to those in the above-described first embodiment, and therefore, similar constituent elements are represented by the same reference numerals or symbols, and will be omitted from illustration and description or will be briefly described. In the following, a point different from the first embodiment will be principally described.

In the case where the coil pattern 301 of the toner concentration detecting sensor is formed inside the wall surface of the developing device 14*a*, it is preferable that the coil pattern 301 and the developer in the developer container 141 are insulated from each other.

That is, in the case where the coil pattern 301 is formed on the inner wall surface 141*c* of the developer container 141, the coil pattern 301 may preferably be insulated from the developer from two viewpoints that the coil causes short-circuit and that a charging rate between the coil pattern 301 and another portion of the inner wall are prevented from being different.

Therefore, in this embodiment, the coil pattern 301 is formed on the inner wall surface 141*c* of the developer container 141, and the protective members 700 and 700A which are covering (coating) members for covering (coating) the surface of the coil pattern 301 and for insulating the coil pattern 301 are provided. Each of the protective members 700 and 700A may preferably be 500Ω or more in surface resistance value from the above-described two viewpoints.

FIGS. 9 and 10 show a first example of this embodiment, and FIG. 11 shows a second example of this embodiment. First, FIG. 9 is a perspective view showing a state in which the coil pattern 301 which is a detecting portion of the toner concentration detecting sensor 300 is formed as a copper foil pattern on the inside of the wall surface of the developer container 141 similarly as in FIG. 3. A difference from FIG. 3 is that in this example, the protective member 700 is formed so as to coat the coil pattern 301 and the through holes 600 and 601. Incidentally, in the case where a structure of the circuit portion 321 other than the coil pattern 301 is formed inside the wall surface, the protective member 700 is formed so as to coat the structure of the circuit portion 321 other than the coil pattern 301.

In the first example of this embodiment, as the protective member 700, a sheet-like member is used. A forming method of the sheet-like protective member 700 will be described using FIG. 10. FIG. 10 is a schematic view showing a cross-section in the case where a region where the coil pattern 301 in FIG. 9 is mounted on the inside of the wall surface of the developer container 141 is cut along an X-X plane. In FIG. 10, a region where the coil pattern 301 and the through holes 600 and 601 are formed on and in the inner wall surface 141*c* of the developer container 141 is indicated as a mounting region 701.

The sensitivity of the toner concentration detecting sensor lowers with a larger distance between the coil pattern 301 of the resonance circuit and the magnetic material object to be detected, so that a thickness d of the protective member 700 is set at d<2 mm even at a portion with the largest thickness.

Further, the protective member 700 is formed by applying, onto a back surface of a urethane sheet, an adhesive in a sheet shape. As regards the urethane sheet, the sheet can be formed in a small thickness of 200-300 μm. For this reason, even when the coil pattern 301 is coated with the protective member 700, the distance between the coil pattern 301 and the magnetic material object to be detected is not made 2 mm or more, so that it becomes possible to detect the toner concentration at high sensitivity. Incidentally, as the protective member 700, other than the urethane sheet, a PET (polyethyleneterephthalate) sheet or the like which is excellent in elasticity may also be used.

Further, other than the application of the sheet, the protective member 700 may also be formed by applying and solidifying a liquid or paste-like application material (for example, a synthetic rubber adhesive) in a sheet shape. That is, in the case where in the region where the protective member 700 is formed on the inner wall surface 141*c* of the developer container 141, flatness is low and the protective member 700 is liable to be peeled off, the liquid or past-like application material may also be coated and solidified in the sheet shape. By this even in the region where the flatness is low, the protective member 700 can be easily formed.

By using the protective member 700 according to the first example, as shown in part (b) of FIG. 4, the coil pattern 301 contacts the developer in the developing device via the protective member 700. By this, as shown in FIG. 5, at a place in the neighborhood the distance of 0 mm, a fluctuation in carrier ratio in the developer can be detected at good sensitivity.

Next, in the second example of this embodiment, as the protective member 700A, a plate-like member is used. In such a second example, different from the first example, the plate-like protective member 700A is engaged in a recessed portion 702 formed on the inner wall surface 141*c* of the developer container 141, as shown in FIG. 11. That is, in the second example, the coil pattern 301 is formed on the bottom of the recessed portion 702, an opening of this recessed portion 702 is covered with the plate-like protective member 700A. Incidentally, in the case where the structure of the circuit portion 321 other than the coil pattern 301 is formed inside the wall surface of the developer container 141, the protective member 700A is formed so as to also cover the structure of the circuit portion 321 other than the coil pattern 301.

FIG. 11 is a sectional view in the case where a region where the coil pattern 301 is mounted is cut along the X-X plane in FIG. 9 similarly as in FIG. 10, and a mounting region 701A is a region where the coil pattern 301 and the through holes 600 and 601 are formed. In the second example, the recessed portion 702 is formed inside the mounting region 701A, and the protective member 700A is accommodated in this recessed portion 702. In other words, the coil pattern 301 is formed on the bottom of the recessed portion 702, and the protective member 700A is engaged in the recessed portion 702 so as to cover this coil pattern 301. In the case of this embodiment, the bottom of the recessed portion 702 constitutes a part of the inner wall surface 141*c* of the developer container 141.

As the protective member 700A, it is possible to cite a member prepared by forming a resin material high in hardness such as ABS (acrylonitrile-butadiene-styrene copolymer) synthetic resin, ABS/PC (polycarbonate), or the like in a plate shape. Further, the protective member 700A is formed so as to conform to the shape of the opening of the recessed portion 702, and is engaged in the recessed portion 702 with no gap. The protective member 700A is disposed so that a portion where the surface of the protective member 700A and the inner wall surface 141*c* of the developer container 141 are adjacent to each other constitute a substantially (same) flat surface or these surfaces are smoothly continuous to each other. Incidentally, it is preferable that the surface of the protective member 700A is not recessed from an adjacent portion of the inner wall surface 141*c* of the developer container 141. This is because in the case where there is a stepped portion between the surface of the protective member 700A and the adjacent portion of the inner wall surface 141*c* of the developer container 141, the flow of the developer is prevented at the stepped portion and thus there is a liability that the disorder of the flow of the developer at the circuit portion 321 is caused.

Further, in the second example, the gap formed between the protective member 700A and the mounting region 701A is filled with a paste-like material (for example, a synthetic rubber adhesive or the like). The protective member 700A and the recessed portion 702 are formed so that a distance d' between the surface of the protective member 700A and the surface (the bottom of the recessed portion 702) of the mounting region 701 becomes d'<2 mm even at the thickest portion.

In the case of the second example, the ABS resin or the ABS/PC is a material also used on the inner wall surface 141*c* of the developer container 141, and a charging rate is the same between on the protective member 700A and its peripheral region, and therefore, the resin is excellent in flowability of the toner.

In such a case of the second example, by providing the protective member 700A, it is possible to suppress a lowering in detection accuracy due to prevention of the flow of the developer by unevenness of the coil pattern 301 or deposition of the carrier on the coil. As a result of this, the fluctuation in carrier ratio in the developer in the developing device can be detected at good sensitivity.

Fourth Embodiment

A fourth embodiment will be described using part (a) of FIG. 12 to part (c) of FIG. 13. In this embodiment, of the inner wall surface 141*c* of the developer container 141, a portion where the coil pattern 301 is formed is projected from another portion. Other constitutions and actions are similar to those in the above-described first embodiment, and therefore, similar constituent elements are represented by the same reference numerals or symbols, and will be omitted from illustration and description or will be briefly described. In the following, a point different from the first embodiment will be principally described.

In order to accurately detect the toner concentration in the developer container 141 in the toner concentration detecting sensor 300, it is preferable that the developer is sufficiently filled in a detecting region of the coil pattern 301. For this reason, as shown in part (a) of FIG. 12, in the case where the amount of the developer accommodated in the detecting region of the coil pattern 301 is insufficient, the toner concentration cannot be accurately detected. Therefore, as shown in part (b) of FIG. 12, an increase in amount of the developer accommodated in the developer container 141 would be considered. In this case, the developer is always sufficiently filled in the detecting region of the coil pattern 301, and therefore, the toner concentration is easily detected with accuracy. However, when the amount of the developer in the developer container 141 is increased, it takes time until the amount of the developer decreases to an amount in which the developer should be supplied even when the image formation is carried out, so that a time in which the developer stagnates in the developer container 141. As a result of this, the developer is liable to deteriorate, so that there is a liability that a lowering in image quality is caused.

On the other hand, as shown in part (c) of FIG. 12, the case where the amount of the developer is not increased and the coil pattern 301 is disposed on the bottom of the developer container 141 will be considered. In this case, a state in which the developer is sufficiently filled in the detecting region of the coil pattern 301 can be formed. However, on the bottom of the developer container 141, the developer low in flowability is deposited. This is because the developer in the neighborhood the bottom of the developer container 141 tends to stagnate by its own weight. For this reason, the toner concentration, should be originally detected, of the developer consumed by the image formation cannot be detected with accuracy.

Therefore, in this embodiment, as shown in part (d) of FIG. 12, in order to detect the developer which is consumed by the image formation and which is high in flowability, the coil pattern 301 is disposed in the neighborhood of a developer surface. Further, a portion where the coil pattern 301 is formed is projected from another portion. That is, a part of the inner wall surface 141*c* of the developer container 141 is formed in a projected portion (protruded portion) 311 projected toward the inside, and the coil pattern 301 is formed at this projected portion 311. A developer feeding passage is made narrower in the region where the coil pattern 301 is formed than in another region. That is, when the developer container 141 is viewed in a cross-section perpendicular to the developer feeding direction (rotational axis direction) of the feeding screw 144, a cross-sectional area of the developer feeding passage in the region where the coil pattern 301 is formed is smaller than a cross-sectional area of the developer feeding passage in a region upstream of the region with respect to the developer feeding direction of the feeding screw 144*b*.

By this, even when the developer surface is lowered by consumption of the developer through the image formation, the developer is fed so as to go up the projected portion 311 where the coil pattern 301 is formed, so that a state in which a sufficient developer is filled in the detecting region of the coil pattern 301 can be formed. By this, the toner concentration of the developer high in flowability can be accurately detected.

In this embodiment, a shape of the projected portion 311 where the coil pattern 301 is formed is a shape as shown in part (a) of FIG. 13. That is, a top surface of the projected portion 311 is a flat surface and is continuous to an adjacent portion via a smoothly inclined portion 312. This inclined portion 312 has an inclination angle such that the developer fed at a periphery of this inclined portion 312 is not dammed up. Further, entirety of the coil pattern 301 is formed at the flat surface portion of the projected portion 311.

However, the shape of the projected portion 311 is not limited to the above-described shape. For example, as shown in part (b) of FIG. 13, only a central portion of the coil pattern 301 is formed at a flat surface portion of a projected portion 311A, and another portion (region) of the coil pattern 301 is formed at an inclined portion 312A. Further, as shown in part (c) of FIG. 13, entirety of a projected portion 311B is formed in a curved surface shape and entirety of the coil pattern 301 may have a structure such that the coil pattern 301 is formed in a curved surface shape. Even when the shape is a shape other than the shapes cited above, the shape is not limited thereto if the toner concentration can be properly detected while ensuring the flowability of the developer.

Further, in the structure shown in part (a) of FIG. 13, the flat surface portion of the projected portion 311 where the coil pattern 301 is formed may also be inclined toward an upstream side with respect to the developer feeding direction. By this, the fed developer efficiently flows through the portion where the coil pattern 301 is formed, and therefore, the detection accuracy can be further improved.

Other Embodiments

In the above-described embodiments, the examples in which the coil pattern 301 and the circuit portion 321 are formed by the metal films integrally with the developer container 141, i.e., are formed by the method of construction of the MID were described. However, the present invention may only be required that at least the coil pattern 301 is formed integrally with the developer container 141 by the method of construction of the MID, and as regards the circuit portion 321, the circuit portion 321 is separately formed on a board or a sheet material, and then the board or the like may also be mounted on the inner wall or the outer wall of the developer container 141.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-009427 filed on Jan. 25, 2021, which is hereby incorporated by reference herein in its entirety.

What is claimed is:

1. A developing device comprising:

a developer carrying member configured to carry a developer, containing toner and a carrier, for developing an electrostatic latent image formed on an image bearing member;

a developer container configured to accommodate the developer; and an oscillation circuit including a resonance circuit including a coil and a circuit portion containing a capacitor and configured to oscillate a signal for detecting a toner concentration of the developer accommodated in said developer container, wherein said developer container includes an inner wall surface which is a wall surface on a side where the developer is accommodated and an outer wall surface which is a wall surface on a side where the developer is not accommodated, and wherein said coil is formed integrally with said developer container by a metal film, and said coil is disposed on said inner wall surface of said developer container.

2. A developing device according to claim 1, wherein said circuit portion is disposed on said outer wall surface of said developer container.

3. A developing device according to claim 2, wherein said coil and said circuit portion are connected to each other via a through hole penetrating said inner wall surface of said developer container and said outer wall surface of said developer container.

4. A developing device according to claim 3, wherein the through hole is closed with a sealing member.

5. A developing device according to claim 2, wherein said circuit portion is formed integrally with said developer container by a metal film.

6. A developing device according to claim 1, wherein said circuit portion is disposed on said inner wall surface of said developer container.

7. A developing device according to claim 6, wherein said circuit portion is disposed on a side wall portion of said inner wall surface of said developer container.

8. A developing device according to claim 6, further comprising a feeding member configured to feed the developer accommodated in said developer container, wherein said circuit portion is provided downstream of said coil with respect to a developer feeding direction of said feeding member.

9. A developing device according to claim 8, wherein said circuit portion is disposed on a side wall portion of said inner wall surface of said developer container.

10. A developing device according to claim 6, wherein said circuit portion is formed integrally with said developer container by a metal film.

11. A developing device according to claim 1, further comprising an insulating member configured to insulate said coil and the developer accommodated in said developer container, wherein a surface of said coil is coated with said insulating member.

12. A developing device according to claim 11, wherein a surface resistance value of said insulating member is 500Ω or more.

13. A developing device according to claim 1, wherein said circuit portion is formed integrally with said developer container by a metal film.

* * * * *